US012410547B2

(12) United States Patent
Lu et al.

(10) Patent No.: US 12,410,547 B2
(45) Date of Patent: Sep. 9, 2025

(54) CLOTHING WASHING SYSTEM, APPARATUS FOR GENERATING NANO MICROBUBBLE IONIC WATER, AND METHOD OF WASHING CLOTHES

(71) Applicant: Nanoplus Ltd., Grand Cayman (KY)

(72) Inventors: Hung-Tu Lu, Taipei (TW); Tak Ngai Samuel Si, Taipei (TW)

(73) Assignee: Nanoplus Ltd., Grand Cayman (KY)

( * ) Notice: Subject to any disclaimer, the term of this patent is extended or adjusted under 35 U.S.C. 154(b) by 454 days.

(21) Appl. No.: 17/718,247

(22) Filed: Apr. 11, 2022

(65) Prior Publication Data

US 2023/0175190 A1 Jun. 8, 2023

(30) Foreign Application Priority Data

Dec. 3, 2021 (TW) ..... 110145317

(51) Int. Cl.

| | |
|---|---|
| ***D06F 35/00*** | (2006.01) |
| ***D06F 39/04*** | (2006.01) |
| *D06F 103/20* | (2020.01) |
| *D06F 105/10* | (2020.01) |

(52) U.S. Cl.

CPC ..... *D06F 35/003* (2013.01); *D06F 35/002* (2013.01); *D06F 39/04* (2013.01); *D06F 35/001* (2013.01); *D06F 2103/20* (2020.02); *D06F 2105/10* (2020.02)

(58) Field of Classification Search

CPC .... D06F 35/003; D06F 35/001; D06F 35/002; D06F 39/04; D06F 2103/20; D06F 2105/10

See application file for complete search history.

(56) References Cited

U.S. PATENT DOCUMENTS

2010/0181208 A1* 7/2010 Denison ..... A47L 15/42 204/263
2023/0027459 A1* 1/2023 Zhao ..... B01F 25/31243

FOREIGN PATENT DOCUMENTS

| | | | |
|---|---|---|---|
| CN | 108166211 | A | 6/2018 |
| CN | 108411326 | A | 8/2018 |
| CN | 108842384 | A | 11/2018 |
| CN | 110482669 | A | 11/2019 |

(Continued)

OTHER PUBLICATIONS

Machine translation of KR 10-2019-0128924 A to Oh. (Year: 2019).*

(Continued)

*Primary Examiner* — Joseph L. Perrin
(74) *Attorney, Agent, or Firm* — HSML P. C.

(57) ABSTRACT

The subject disclosure relates to a clothing washing system, an apparatus for generating nano microbubble ionic water, and a method of washing clothes. The clothing washing system includes an adjustment unit, an electrolysis unit, a first fluid circulation unit, a nano microbubble generation unit, a second fluid circulation unit, and a cleaning unit. The electrolysis unit is in fluid communication with the adjustment unit. The first fluid circulation unit is connected to the adjustment unit and the electrolysis unit. The nano microbubble generation unit is in fluid communication with the adjustment unit. The second fluid circulation unit is connected to the adjustment unit and the nano microbubble generation unit. The cleaning unit is in fluid communication with the adjustment unit.

12 Claims, 10 Drawing Sheets

(56) References Cited

FOREIGN PATENT DOCUMENTS

| | | | | | |
|---|---|---|---|---|---|
| CN | 107022871 | B | | 1/2020 | |
| CN | 108474164 | B | | 6/2020 | |
| CN | 113417114 | A | | 9/2021 | |
| EP | 2397062 | B1 | * | 7/2013 | ..... A47L 15/4236 |
| JP | 2006204562 | A | | 8/2006 | |
| JP | 200714867 | A | | 1/2007 | |
| JP | 200768346 | A | | 10/2007 | |
| JP | 2012515634 | A | * | 7/2012 | |
| JP | 2018175443 | A | | 11/2018 | |
| KR | 20110008838 | A | * | 1/2011 | |
| KR | 20190128924 | A | * | 11/2019 | |
| TW | I603777 | B | | 11/2017 | |
| WO | 2020179667 | A1 | | 9/2020 | |

OTHER PUBLICATIONS

Machine translation of JP 2012-515634 A. (Year: 2012).*
Machine translation of KR 10-2011-0008838 A to Oh. (Year: 2011).*
Machine translation of EP 2397062 B1 to Gau et al. (Year: 2013).*
Office Action issued in Korean Application No. 10-2022-0047770, dated Nov. 28, 2023, with English translation.

* cited by examiner

ORP change comparison effect

CLOTHING WASHING SYSTEM, APPARATUS FOR GENERATING NANO MICROBUBBLE IONIC WATER, AND METHOD OF WASHING CLOTHES

BACKGROUND OF THE INVENTION

1. Field of the Invention

The subject disclosure relates to a clothing washing system, an apparatus for generating nano microbubble ionic water, and a method of washing clothes, and specifically, to a clothing washing system using nano microbubble ionic water as washing liquid.

2. Description of the Related Art

Clothing generally refers to woven or non-woven fabrics, including clothes, towels, gloves, window curtains and curtains that are large, and the like. Due to different sources, clothing dirt can be classified into two categories: clothing dirt in a process/clean room and general household clothing dirt. The clothing dirt in a process or clean room mainly includes dust and chemicals as contaminants. The general household clothing dirt commonly includes, in addition to dust, tannins (juice/coffee/wine), proteins (body sweat/saliva/urine), pen ink (ball pen/oily universal pen), oils (soup/liquid foundation), and the like. Conventionally, a laundry detergent or chemical detergent is used as a main cleaning and decontamination material. After years of improvement, the cleaning capability has reached a fairly high level, but following shortcomings are present: Detergent ingredients make the waste water complex and are not conducive to the environment ecology, an interface active agent in the detergent is likely to scale in a washing tank and cause secondary pollution, and the detergent residue may still damage the human skin and cause allergic reactions.

According to the above, a clothing washing system and a method thereof without using a laundry detergent or chemical detergent have become an important issue in pursuit of environmental protection and maintenance of human health, including achieving the clothing washing effect by replacing a laundry liquid or chemical detergent with technologies such as electrolyzed water/nano ionic water, ozone, or nano microbubble water.

A conventional composite fully automatic washing machine includes a sodium chloride adding apparatus and an electrolysis apparatus, delivers, by controlling the concentration of sodium chloride, ozone compressed air and hypochlorite-containing electrolyzed water into a washing tank, and stirs them together with clothes, so as to achieve the effects of sterilization, bleaching, and decontamination. Another conventional washing machine provides an apparatus for generating fine bubbles and a control apparatus. The fine bubbles mainly include nano microbubbles and are used to promote the dissolution efficiency of chemical laundry detergents.

Other patent applications of the applicant disclose an apparatus for generating nano ionic water by electrolysis and a system for manufacturing nano microbubbles and cleaning. However, although the above patent applications are not used for clothing washing but for cleaning of inorganic objects or process objects such as glass, sapphire, silicon, metal, electronic components, ceramics, and wafers, they lay a breakthrough foundation for clothing washing applications without the use of a laundry liquid or chemical detergent.

SUMMARY OF THE INVENTION

In some embodiments, the subject disclosure provides a clothing washing system including an adjustment unit, an electrolysis unit, a first fluid circulation unit, a nano microbubble generation unit, a second fluid circulation unit, and a cleaning unit. The electrolysis unit is in fluid communication with the adjustment unit. The first fluid circulation unit is connected to the adjustment unit and the electrolysis unit. The nano microbubble generation unit is in fluid communication with the adjustment unit. The second fluid circulation unit is connected to the adjustment unit and the nano microbubble generation unit. The cleaning unit is in fluid communication with the adjustment unit.

In some embodiments, the subject disclosure provides an apparatus for generating nano microbubble ionic water, including: a first unit, configured to receive external fluid; a second unit, configured to perform electrolysis; a third unit, configured to circulate the fluid between the first unit and the second unit; a fourth unit, being in fluid communication with the first unit and configured to generate nano microbubbles; and a fifth unit, configured to circulate the fluid between the first unit and the fourth unit.

In some embodiments, the subject disclosure provides a method of washing clothes, including: providing fluid from the outside into an adjustment unit; performing first fluid circulation, where the fluid in the adjustment unit is transferred to an electrolysis unit for electrolysis, and the electrolyzed fluid is transferred from the electrolysis unit to the adjustment unit; performing second fluid circulation, where the electrolyzed fluid is transferred from the adjustment unit to a nano microbubble generation unit for generating a plurality of nano microbubbles in the fluid, and the fluid with the plurality of nano microbubbles is transferred from the nano microbubble generation unit to the adjustment unit; and transferring the fluid with the plurality of nano microbubbles from the adjustment unit to a cleaning unit.

The technical features of the subject disclosure have been quite extensively summarized above, so that the detailed description of the subject disclosure below can be better understood. Other technical features that constitute the scope of the patent application of the subject disclosure will be described below. A person of ordinary skill in the art of the subject disclosure should understand that the concepts and specific embodiments disclosed below can be used fairly easily to modify or design other structures or processes to achieve the same purpose as the subject disclosure. A person of ordinary skill in the art of the subject disclosure should also understand that such equivalent constructions cannot depart from the spirit and scope of the subject disclosure as defined by the attached patent scope.

BRIEF DESCRIPTION OF THE DRAWINGS

An aspect of the subject disclosure will be better understood from the following embodiments and the accompanying drawings. It should be noted that according to industry standard practice, various features are not drawn to actual scale. In fact, for clear description, the size of various features can be enlarged or reduced arbitrarily.

PREFERRED EMBODIMENT OF THE PRESENT INVENTION

Figure 1:
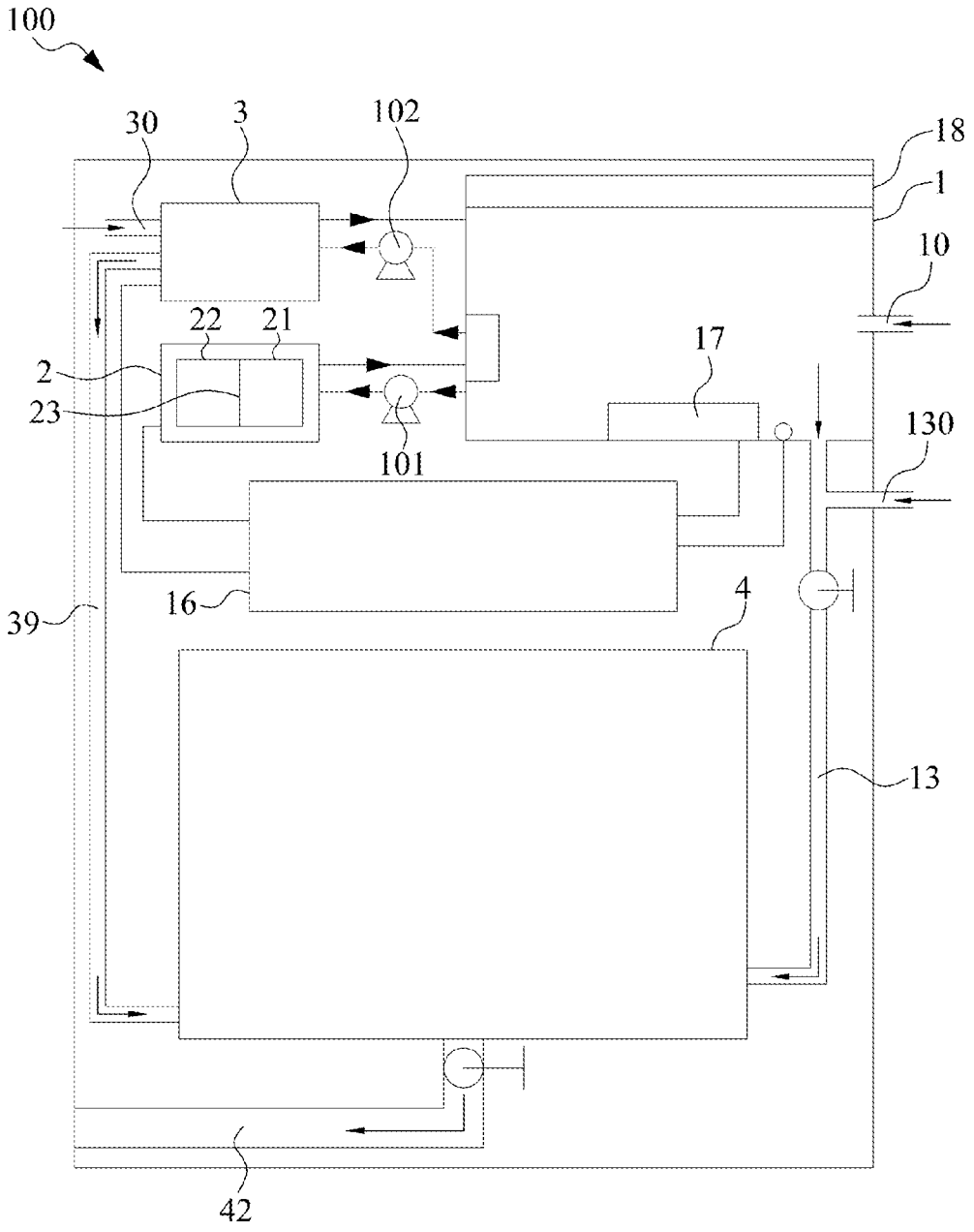
FIG. 1 is a schematic diagram of a clothing washing system according to an embodiment of the subject disclosure.

To make the objectives, features, and effects of the subject disclosure understood, the subject disclosure is described below in detail using specific embodiment with reference to descriptions of figures.

Specific structures and functional details disclosed in this specification are merely representative, and are intended to describe the exemplary embodiments of the subject disclosure. However, the subject disclosure may be specifically implemented in many alternative forms, and should not be construed as being limited to the embodiments set forth herein.

In the descriptions of the subject disclosure, it should be understood that the terminologies of electrochemistry or physics indicated by the terms "cathode", "negative electrode", "anode", "positive electrode", "alkaline ion", "hydroxide ion", and the like are unified descriptions based on the subject disclosure and are merely for helping describe the subject disclosure and simplifying the description, rather than specifying or narrowing their essential literal interpretations, and therefore, shall not be construed as limitations of the subject disclosure. In addition, the terms "first" and "second" are used merely for the purpose of description, and shall not be construed as indicating or implying relative importance or implying a quantity of indicated technical features. Therefore, features defining "first" and "second" may explicitly or implicitly include one or more such features. In the description of this specification, unless otherwise stated, "a plurality of" means two or more. In addition, the terms "include", "comprise" and any variant thereof are intended to cover non-exclusive inclusion.

In addition, for the convenience of description, spatially relative terms (such as "below", "under", "down", "above", "up", and "over") can be used in the subject disclosure to describe a relationship between an assembly or a component and another assembly (other assemblies) or component (components), as shown in the figures. In addition to orientations shown in the figures, the spatially relative terms are also intended to encompass different orientations of the apparatus in use or operation. The device may be oriented in other manners (rotate by 90 degrees or in other orientations), and the spatially relative descriptors used in this specification can also be interpreted in this way.

As used in this specification, the terms "approximately", "substantially", "essentially", and "about" are used to describe and explain small variations. When being used in combination with an event or a condition, the term may refer to an instance in which the event or condition occurs precisely and an instance in which the event or condition occurs extremely closely. For example, when being used in combination with a value, the term may involve a variation range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, when a difference between two values is less than or equal to ±10% of an average value of the values (for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to 0.05%), the values may be regarded as "substantially" the same or equal. For example, being "substantially" parallel may involve an angular variation range of less than or equal to ±10° with respect to 0°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, being "substantially" perpendicular may involve an angular variation range of less than or equal to ±10° with respect to 90°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Nano microbubbles are bubbles that are so small that they cannot be seen directly by the naked eye, and have extremely special physical and chemical properties. At present, fine bubbles below 1 μm are defined as nano microbubbles, and the nano microbubbles have extremely special physical and chemical properties (in terms of pressure, temperature, ejection, evaporation, dissolution, various reactions, and the like). The nano microbubbles are currently widely used in cleaning, water processing, agriculture/plant cultivation, medical treatment/medicine, chemistry, food/drink, cosmetics, liquid crystal/semiconductor/solar cell manufacturing, new material manufacturing, and the like.

The subject disclosure provides a clothing washing system and a washing method using nano microbubble ionic water, which not only requires no use of chemical detergents, but also more specially, can obtain, by studying a descaling system and operating parameters for properties of soiled clothes, an efficient and environmentally friendly decontamination effect through a cleaning capability of nano ionic water, a cleaning capability of nano microbubble water, and the interaction of the two cleaning capabilities.

FIG. 1 is a schematic diagram of a clothing washing system 100 according to an embodiment of the subject disclosure. As shown in FIG. 1, the clothing washing system 100 includes an adjustment unit 1, an electrolysis unit 2, a nano microbubble generation unit 3, a cleaning unit 4, a first fluid circulation unit 101, and a second fluid circulation unit 102. In some embodiments of the subject disclosure, the adjustment unit 1 includes an adjustment tank, configured to receive fluid from the outside and store the fluid. The adjustment unit 1 includes a fluid inlet 10. The fluid inlet 10 may be connected to an external fluid source (not disclosed), and fluid from the outside can flow into the adjustment unit 1 through the fluid inlet 10 from the external fluid source. In some embodiments of the subject disclosure, the external fluid source includes a tap water source, and the fluid from the outside includes tap water.

The electrolysis unit 2 is in fluid communication with the adjustment unit 1, and the electrolysis unit 2 is configured to perform electrolysis. In some embodiments of the subject disclosure, the electrolysis unit 2 includes a cathode electrolysis cell 21 equipped with a negative electrode, an anode electrolysis cell 22 equipped with a positive electrode, and a waterproof ion exchange membrane 23 located between the cathode electrolysis cell 21 and the anode electrolysis cell 22 and configured to prevent fluid from circulating between the cathode electrolysis cell 21 and the anode electrolysis cell 22. In some embodiments of the subject disclosure, the cathode electrolysis cell 21 is configured to receive the fluid from the adjustment unit 1 and perform electrolysis on the fluid. The electrolysis performed by the electrolysis unit 2 changes the pH value and oxidation-reduction potential (ORP) of the water in an electrolysis manner, and then decomposes the water to produce $O_2$ and $H_2$. A half reaction in the cathode electrolysis cell 21 is: $2H_2O+2e^-=2OH^-+H_2$, where the hydroxide ion ($OH^-$) is an alkaline ion with reducing power. Therefore, the cathode electrolysis cell 21 can electrolyze the tap water injected therein to produce alkaline electrolyzed ionic water with hydroxide ions and hydrogen micron bubbles.

The first fluid circulation unit 101 is connected to the adjustment unit 1 and the electrolysis unit 2. The first fluid circulation unit 101 is configured to transfer fluid loaded in the adjustment unit 1 to the electrolysis unit 2 and transfer the fluid loaded in the electrolysis unit 2 to the adjustment unit 1. In other words, the first fluid circulation unit 101 is configured to circulate the fluid between the adjustment unit 1 and the electrolysis unit 2, so that the is first fluid circulation unit 101, the adjustment unit 1, and the electrolysis unit 2 may jointly form a fluid circulation path. In some embodiments of the subject disclosure, the first fluid circulation unit 101 uses a pump as a power for transferring the fluid.

According to the above, the tap water may be injected into the adjustment unit 1 from the fluid inlet 10 of the adjustment unit 1, and injecting the tap water into the adjustment unit 1 is not stopped until the injected tap water reaches a target water level. Subsequently, the first fluid circulation unit 101 is started up to draw the tap water in the adjustment unit 1 to the cathode electrolysis cell 21 of the electrolysis unit 2 until the tap water reaches a specific liquid level in the cathode electrolysis cell 21, and then the electrolysis unit 2 is started up to perform the electrolysis on the tap water.

After the electrolysis unit 2 performs electrolysis for a period of time, the cathode electrolysis cell 21 electrolyzes the injected tap water to produce alkaline electrolyzed ionic water with hydroxide ions and hydrogen micron bubbles. Subsequently, the first fluid circulation unit 101 is started up to transfer, back to the adjustment unit 1, the alkaline electrolyzed ionic water with hydroxide ions and hydrogen micron bubbles generated by electrolysis in the cathode electrolysis cell 21. The foregoing process of transferring the fluid in the adjustment unit 1 to the electrolysis unit 2 through the first fluid circulation unit 101 for electrolysis, and then transferring the electrolyzed fluid from the electrolysis unit 2 back to the adjustment unit 1 through the first fluid circulation unit 101 is first fluid circulation. After several times of first fluid circulation, the cathode electrolysis cell 21 also produces nano alkaline electrolyzed ionic water. The nano alkaline electrolyzed ionic water includes 4 to 6 $H_2O$ molecules, and the pH value in the cathode electrolysis cell 21 is between 10 and 13.

Referring to FIG. 1 again, the nano microbubble generation unit 3 is in fluid communication with the adjustment unit 1, and the nano microbubble generation unit 3 is configured to cause the fluid to generate nano-sized microbubbles. In some embodiments of the subject disclosure, the nano microbubble generation unit 3 uses a high-pressure and mechanical cutting assembly inside, which can cut gas (bubbles) in the fluid injected into the nano microbubble generation unit 3 into smaller nano-sized microbubbles and retain the nano microbubbles in the fluid without any external energy source.

In some embodiments of the subject disclosure, the nano microbubble generation unit 3 may include a fluid inlet 30. The fluid inlet 30 may be connected to an external fluid source (not disclosed), and fluid from the outside can flow into the adjustment unit 3 through the fluid inlet 30 from the external fluid source. In some embodiments of the subject disclosure, the external fluid source includes a tap water source, and the fluid from the outside includes tap water. Therefore, the nano microbubble generation unit 3 may have external fluid (for example, tap water) injected thereto through the fluid inlet 30, and then introduce external gas such as air or introduce ozone from an injection apparatus of an ozone generator. Then, the external gas and the external fluid may generate nano microbubbles in the nano microbubble generation unit 3.

The second fluid circulation unit 102 is connected to the adjustment unit 1 and the nano microbubble generation unit 3. The second fluid circulation unit 102 is configured to transfer fluid loaded in the adjustment unit 1 to the nano microbubble generation unit 3 and transfer the fluid loaded in the nano microbubble generation unit 3 to the adjustment unit 1. In other words, the second fluid circulation unit 102 is configured to circulate the fluid between the adjustment unit 1 and the nano microbubble generation unit 3, so that the second fluid circulation unit 102, the adjustment unit 1, and the nano microbubble generation unit 3 may jointly form a fluid circulation path. In some embodiments of the subject disclosure, the second fluid circulation unit 102 uses a pump as a power for transferring the fluid.

According to the above, the alkaline electrolyzed ionic water and hydrogen micron bubbles generated by electrolysis in the electrolysis unit 2 and stored in the adjustment unit 1 may be transferred from the adjustment unit 1 to the nano microbubble generation unit 3 by the second fluid circulation unit 102. The nano microbubble generation unit 3 may cut the hydrogen micron bubbles into smaller hydrogen nano microbubbles, and keep the hydrogen nano microbubbles in the electrolyzed ionic water. Subsequently, the second fluid circulation unit 102 transfers the ionic water containing the hydrogen nano microbubbles from the nano microbubble generation unit 3 to the adjustment unit 1. The foregoing process of transferring the fluid containing microbubbles in the adjustment unit 1 to the nano microbubble generation unit 3 through the second fluid circulation unit 102 for generating nano microbubbles, and then transferring the fluid that has been subjected to the process and contains the nano microbubbles from the nano microbubble generation unit 3 back to the adjustment unit 1 through the second fluid circulation unit 102 is second fluid circulation. After several times of second fluid circulation, the number and concentration of the nano microbubbles contained in the fluid in the adjustment unit 1 may be increased to a specific extent.

Referring to FIG. 1 again, the cleaning unit 4 is in fluid communication with the adjustment unit 1 through a pipeline 13, so that the cleaning unit 4 may receive the fluid from the adjustment unit 1. In some embodiments of the subject disclosure, the pipeline 13 may be in fluid communication with a fluid inlet 130, and therefore, the external fluid may enter the pipeline 13 through the fluid inlet 130. In some embodiments of the subject disclosure, the cleaning unit 4 includes a cleaning tank. The cleaning unit 4 may accommodate to-be-washed clothes. After several times of second fluid circulation, the number and concentration of the nano microbubbles contained in the fluid (for example, ionic water containing hydrogen nano microbubbles) in the adjustment unit 1 may be increased to a specific extent. The fluid containing nano microbubbles may be injected from the adjustment unit 1 into the cleaning unit 4, and the fluid containing the nano microbubbles may be used as washing liquid for clothing washing to wash clothes. In addition, the cleaning unit 4 includes a discharge pipeline 42 configured to discharge excess or used washing liquid.

In some embodiments of the subject disclosure, the cleaning unit 4 may be in fluid communication with the nano microbubble generation unit 3 through a pipeline 39. Therefore, the cleaning unit 4 may receive the fluid from the nano microbubble generation unit 3 through the pipeline 39. In other words, the fluid with nano microbubbles generated by the nano microbubble generation unit 3 may be directly transferred to the cleaning unit 4.

In addition, the clothing washing system 100 further includes a detection unit 16, a warming unit 17, and a hydrogen processing unit 18. The detection unit 16 may be connected to the adjustment unit 1, the electrolysis unit 2, and the nano microbubble generation unit 3, and its main function is to detect parameters and values in the apparatuses or tanks such as the adjustment unit 1, the electrolysis unit 2, and the nano microbubble generation unit 3, including the number of the hydrogen nano microbubbles, the pH value, the ORP, the temperature, electrical conductivity, and the like, so that the conditions and the composition of the washing liquid drawn from the adjustment unit 3 and injected into the cleaning unit 4 may achieve an optimized washing effect.

The warming unit 17 is installed in the adjustment unit 1, and is configured to heat the fluid loaded in the adjustment unit 1. The hydrogen processing unit 18 is also installed in the adjustment unit 1. The (hydrogen) bubbles generated by the electrolysis unit 2 and the remaining oxygen that has passed through the nano microbubble generation unit 3 and does not become the nano microbubbles pass through the hydrogen processing unit 18, and the hydrogen processing unit 18 discharges the excess hydrogen, thereby reducing the hydrogen concentration to a safe level.

To achieve the foregoing optimized washing effect, the detection unit 16 further includes start-up and stopping instructions and control for a hydrogen processing apparatus 8, a warming apparatus 7, the first fluid circulation unit 101, the second fluid circulation unit 102, and the like. The issuance of the control and instructions is a response based on the parameters and values reported and detected by a detection apparatus 5.

For the issuance of the control and instructions, the detection unit 16 preferably enables the number of the hydrogen microbubbles continuously generated by the electrolysis unit 2 to meet the needs of the nano microbubble generation unit 3 for generating hydrogen nano microbubbles without using external hydrogen gas. Further, a drawing pump of the first fluid circulation unit 101 is controlled by the detection unit 16, so that the fluid leaving the electrolysis unit 2 is returned to the adjustment unit 1 and the concentration of the hydrogen microbubbles is gradually increased to a target concentration. Then, the fluid of which the concentration of the hydrogen microbubbles has been increased is drawn, using a drawing pump of a second fluid circulation apparatus 52, from the adjustment unit 1 to the nano microbubble generation unit 3 to manufacture hydrogen nano microbubbles.

The detection unit 16 additionally performs safety management and control on the amount of escaping hydrogen gas. During circulation of the washing liquid, inevitably, there are extremely few large hydrogen bubbles that escape and leave the cathode electrolysis cell 21 or a liquid surface in the adjustment unit 1. A detection apparatus 6 detects the concentration of the escaping hydrogen, further collects the escaping hydrogen, and dilutes the escaping hydrogen with air or other inert gas at least 500 times or more or to a safety threshold of less than 0.2% by a hydrogen processing apparatus.

The detection unit 16 also performs temperature management and control on the fluid in the adjustment unit 1, and keeps the temperature between 200° C. and 800° C. according to a temperature range of a parameter target. When the actual temperature of the fluid is lower than the parameter target range, the warming apparatus 7 is used to heat the fluid to the parameter target range.

After several times of second fluid circulation, the number and concentration of the nano microbubbles contained in the fluid (for example, ionic water containing hydrogen nano microbubbles) in the adjustment unit 1 are continuously increased. When detecting that the detection parameters of the fluid containing nano microbubbles in the adjustment unit 1 all have reached the parameter targets, the detection unit 16 may control the input of the adjustment unit 1 to the cleaning unit 4, so that the fluid containing nano microbubbles starts to be injected into the cleaning unit, and after the injected fluid reaches a specific liquid level, a cleaning step is started. The foregoing parameter targets include at least: the pH value of 11 to 13, the ORP of −500 to −900 mV, the electrical conductivity of 5 to 10 mS/cm, and the temperature of 20° C. to 80° C.

In summary, the clothing washing system 100 of the subject disclosure may be regarded as including an apparatus for generating nano microbubble ionic water and a cleaning apparatus for washing clothes. The apparatus for generating nano microbubble ionic water may include the adjustment unit 1, the electrolysis unit 2, the nano microbubble generation unit 3, the first fluid circulation unit 101, the second fluid circulation unit 102, the detection unit 16, the warming unit 17, and the hydrogen processing unit 18. Moreover, the cleaning apparatus for washing clothes may include the cleaning unit 4.

Figure 2:
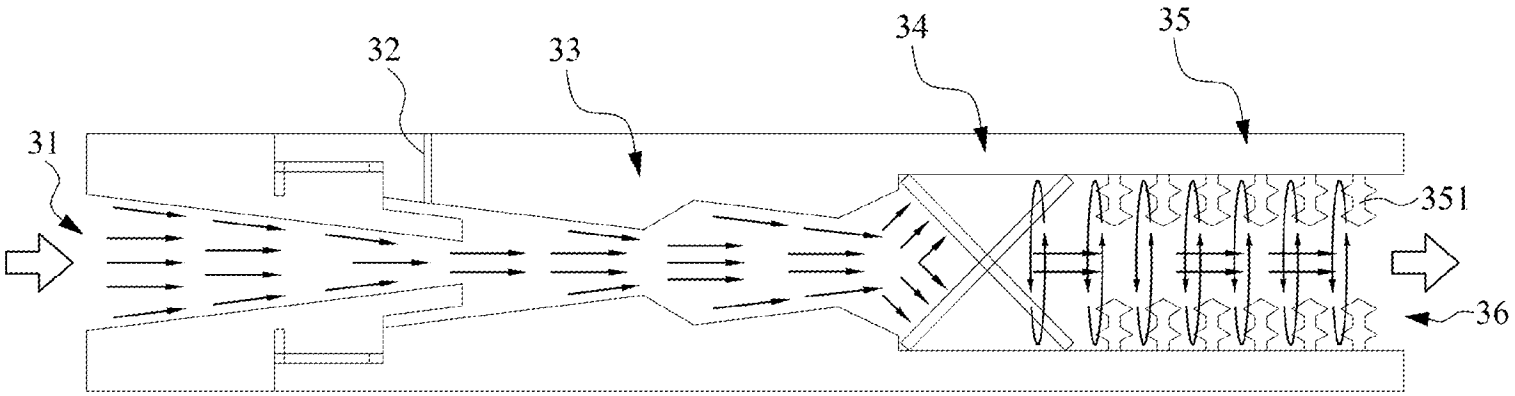
FIG. 2 is a schematic diagram of a nano microbubble generation unit according to an embodiment of the subject disclosure.

FIG. 2 is a schematic diagram of the nano microbubble generation unit 3 according to an embodiment of the subject disclosure. As shown in FIG. 2, the nano microbubble generation unit 3 includes a fluid inlet end 31, an external gas inlet end 32, a gas-liquid mixing section 33 including a plurality of water flow variable speed regions, a gas-liquid rotary pressurization section 34, a nano microbubble mechanical cutting section 35, and a fluid outlet end 36.

In some embodiments, the fluid inlet end 31 is connected to the second fluid circulation unit 102. In this way, the nano microbubble generation unit 3 may introduce the fluid with microbubbles (for example, electrolyzed ionic water with hydrogen micron bubbles) from the adjustment unit 1 into it through the fluid inlet end 31. When the fluid with microbubbles enters the gas-liquid mixing section 33 through the fluid inlet end 31, the fluid and the microbubbles are mixed in a vortex manner in this section, and then enter the gas-liquid rotary pressurization section 34. In the gas-liquid rotary pressurization section 34, the microbubbles and fluid mixed in a vortex manner are pressurized by mechanical rotation, and then enter the nano microbubble mechanical cutting section 35. In the nano microbubble mechanical cutting section 35, the gas-liquid mixed fluid dissolved by pressurization forms a shear cutting action with an in-pipe cutter 351 of the nano microbubble mechanical cutting section 35 under high-speed rotation, thereby forming nano microbubbles. The diameters of the bubbles are less than 500 nm, preferably, between 50 and 200 nm. Finally, the fluid with nano microbubbles generated through the above process is conveyed out of the nano microbubble generation unit 3 through the fluid outlet end 36. According to the foregoing embodiment, when nano microbubbles are produced using the above method, it is unnecessary to introduce gas from the outside such as an external hydrogen source. In addition, because the volumes of the hydrogen bubbles generated by electrolysis are relatively small, hydrogen nano microbubbles are generated in a safer way with relatively high yield efficiency.

In some embodiments of the subject disclosure, the fluid inlet end 31 may be connected to an external fluid source to receive fluid (for example, tap water) from the outside. When the fluid inlet end 31 introduces the external fluid into the nano microbubble generation unit 3, the external gas inlet end 32 may simultaneously introduce external gas into the nano microbubble generation unit 3. When the external fluid and the external gas enter the gas-liquid mixing section 33, the external fluid and the external gas are mixed in a vortex manner in this section, and then enter the gas-liquid rotary pressurization section 34. In the gas-liquid rotary pressurization section 34, the gas-liquid mixed fluid mixed in a vortex manner is pressurized by mechanical rotation, and then enters the nano microbubble mechanical cutting section 35. In the nano microbubble mechanical cutting section 35, the gas-liquid mixed fluid that is dissolved by pressurization forms a shear cutting action with the in-pipe cutter of the nano microbubble mechanical cutting section 35 under high-speed rotation, thereby forming nano microbubbles. The diameters of the bubbles are less than 500 nm, preferably, between 50 and 200 nm. Finally, the fluid with nano microbubbles generated through the above process is conveyed out of the nano microbubble generation unit 3 through the fluid outlet end 36. In some embodiments of the subject disclosure, the fluid with nano microbubbles produced in this way may be used as washing liquid for pre-washing, and the fluid may be introduced into the cleaning unit 4 before the clothes are formally washed, so as to pre-wash the clothes in the cleaning unit 4.

The relationship between the volume and surface area of the bubble may be expressed by the formula:

> the formula of the volume of the bubble is $V=4\pi/3r^3$, the formula of the surface area of the bubble is $A=4\pi r^2$, and the two formulas may be combined, to obtain $A=3V/r$, that is, $V(\text{total})=nA=3V(\text{total})/r$.

In other words, when the total volume (Vtotal) is constant, the total surface area of the bubble is inversely proportional to the diameter of an individual bubble.

According to the foregoing formula, upon comparison between a bubble of 10 microns and a bubble of 1 mm, under a specific volume, the specific surface area of the former is theoretically 100 times that of the latter, that is, the gas-liquid contact area is increased by 100 times, and various reaction speeds are also increased by 100 times.

Furthermore, according to the Stokes' theorem, the rising speed of the bubble in water is proportional to the square of the diameter of the bubble, and the smaller the diameter of the bubble, the lower the rising speed of the bubble. The rising speed of a bubble having a diameter of 1 mm in water is 6 mm/min, while the rising speed of a bubble having a diameter of 10 μm in water is 3 μm/min. The rising speed of the former is 2000 times that of the latter. If the increase in the specific surface area is taken into consideration, the retention capacity of the nano microbubbles in the fluid is increased by 200,000 (100*2000) times than that in ordinary air.

Further, the negative charge intensity on the surface of the nano microbubble not only depends on the size of the bubble, but also relates to the gas type of the bubble, and the surface charge of the nano microbubble using hydrogen as the nano microbubble gas is relatively high. When the pH value is kept at a specific value, the hydrogen nano microbubble may obtain an extremely low ORP and have the cleaning capability improved. For example, when the pH value is between 12 and 12.5, the ORP of the nano ionic water is between about −50 and −150 mV, and the ORP of the hydrogen nano microbubble (nano microbubble electrolyzed ionic water) is more preferably reduced to between −500 and −900 mV.

Refer to Table 1 for a preparation example of nano ionic water and hydrogen nano microbubble washing liquid in the adjustment unit 1:

| Item | Value |
|---|---|
| Volume of washing liquid | 120 L |
| Time required for preparation | 60 mins |
| Temperature | 60° C. |
| pH value | 12.3 to 12.5 (conversion at 25° C.) |
| Oxidation-reduction potential (ORP) | −900 to −920 mV |
| Content of hydrogen | 1.5 to 1.8 ppm |

Figure 3:
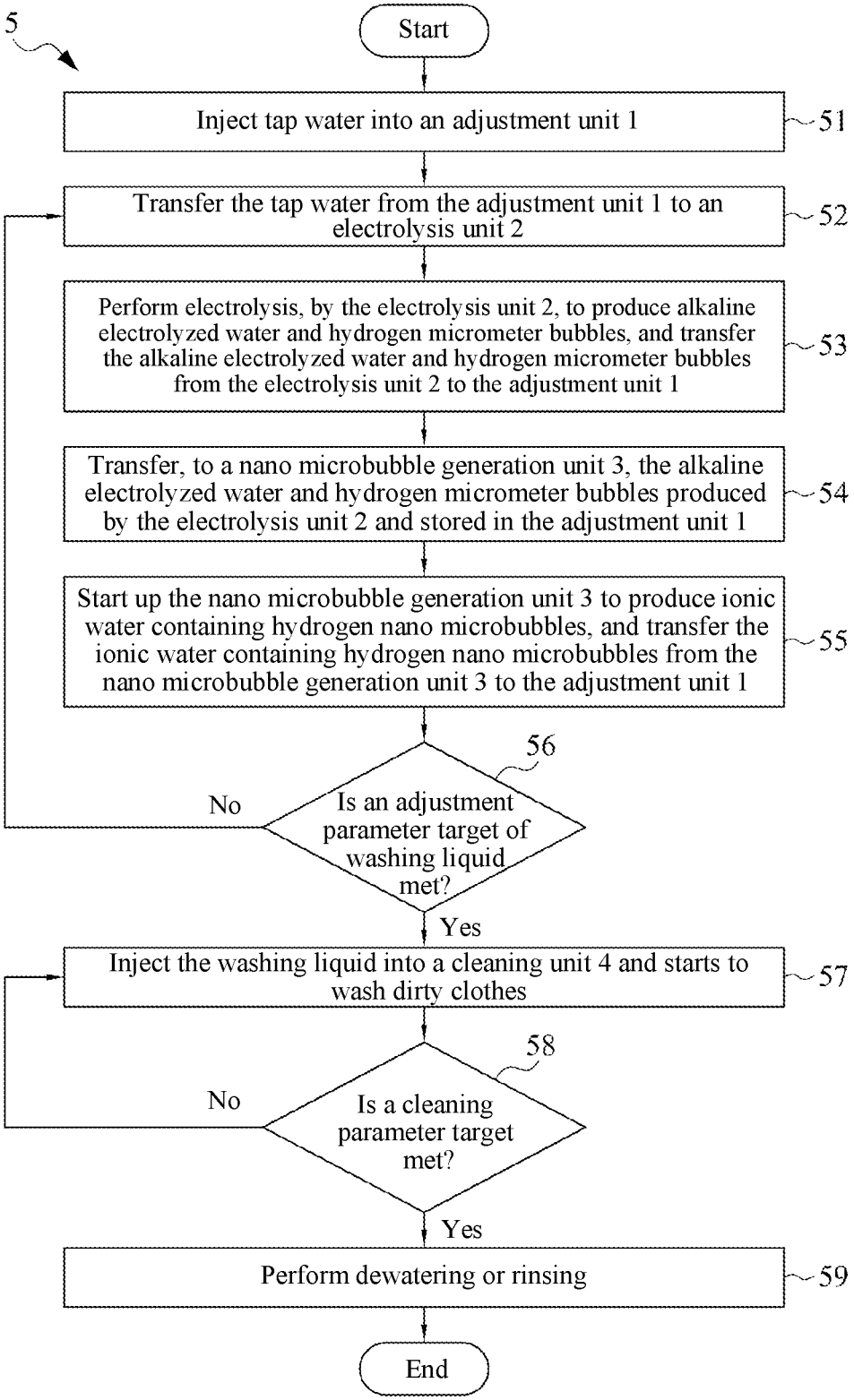
FIG. 3 is a flowchart of a method of washing clothes according to an embodiment of the subject disclosure.

FIG. 3 is a flowchart of a method 5 of washing clothes according to an embodiment of the subject disclosure. In some embodiments of the subject disclosure, the method 5 of washing clothes includes steps 51, 52, 53, 54, 55, 56, 57, 58, and 59.

In step 51, a user may set target parameters of the clothing washing system 100 and start up the clothing washing system; and after the parameter setting and start-up, the fluid inlet 10 of the adjustment unit 1 may inject tap water into the adjustment unit 1 and continue the injection until the detection unit 16 detects that the tap water accommodated in the adjustment unit 1 reaches a target water volume, and then control is performed to stop the tap water injection.

In step 52, the first fluid circulation unit 101 is started up to draw the tap water in the adjustment unit 1 to the cathode electrolysis cell 21 of the electrolysis unit 2 until the tap water reaches a specific liquid level in the cathode electrolysis cell 21.

In step 53, the electrolysis unit 2 performs electrolysis, so that the injected tap water is electrolyzed to produce hydrogen micron bubbles and alkaline electrolyzed water with hydroxide ions; subsequently, the first fluid circulation unit 101 transfers the alkaline electrolyzed water with hydroxide ions and hydrogen micron bubbles generated by electrolysis from the electrolysis unit 2 to the adjustment unit 1. In some embodiments of the subject disclosure, the electrolysis parameters are monitored by the detection unit 16 simultaneously, and the monitored items include a current, a voltage, a water flow rate, an electrolyte concentration in the anode electrolysis cell 22, and the like.

Step 52 and step 53 are the foregoing first fluid circulation, and in some embodiments of the subject disclosure, step 52 and step 53 may be repeated a plurality of times.

In step 54, the second fluid circulation apparatus 52 is started up to draw, from the adjustment unit 1, the alkaline electrolyzed water and hydrogen micron bubbles continuously produced by the electrolysis unit 2 and transferred back to the adjustment unit 1, and inject them into the nano microbubble generation unit 3.

In step 55, the high-pressure and mechanical cutting assembly in the nano microbubble generation unit 3 cuts the hydrogen microbubbles injected into the nano microbubble generation unit 3 into smaller hydrogen nano microbubbles, and subsequently, the second fluid circulation apparatus 52 injects the fluid with hydrogen nano microbubbles generated by the nano microbubble generation unit 3 from the nano microbubble generation unit 3 into the adjustment unit 1.

Step 54 and step 55 are the foregoing second fluid circulation, and in some embodiments of the subject disclosure, step 54 and step 55 may be repeated a plurality of times.

In some embodiments of the subject disclosure, in step 54 and/or step 55, the warming apparatus 7 may be started up to warm, according to the parameter target, the fluid (for example, electrolyzed water with hydrogen micron bubbles or electrolyzed water with hydrogen nano microbubbles) in the adjustment unit 1 to a target temperature range, which is monitored by the detection unit 16, and is preferably between 20° C. and 80° C.

In some embodiments of the subject disclosure, in step 54 and/or step 55, the hydrogen processing apparatus 8 may be started up to dilute the hydrogen that has not been completely converted into nano microbubbles by the nano microbubble generation unit 3 at least 500 times or more (or to a concentration less than 0.2%) in the adjustment unit 1, so as to discharge the hydrogen out of the adjustment unit 1 after a safe level is reached.

In step 56, the detection unit 16 detects whether the various parameters of the electrolyzed water with hydrogen nano microbubbles accommodated in the adjustment unit 1 have reached the set targets for use as washing liquid. In some embodiments of the subject disclosure, the set targets for use as washing liquid include: the pH value of 11 to 13, the ORP of −500 to −900 mV, the electrical conductivity of 5 to 10 mS/cm, and the temperature of 20° C. to 80° C. If the various parameters of the electrolyzed water with hydrogen nano microbubbles accommodated in the adjustment unit 1 have reached the set targets, the procedure proceeds to the next step; and if the various parameters of the electrolyzed water with hydrogen nano microbubbles accommodated in the adjustment unit 1 do not reached the set targets, steps 52, 53, and 54 and/or 55 are performed again.

In step 57, the washing liquid that has reached the set target is injected into the cleaning unit 4 to wash clothes. In this step, the content of hydrogen is 0.5 to 2 ppm, the number of the hydrogen nano microbubbles is 1 to 5 billion particles/ml, and the diameters of the hydrogen bubbles range from 100 to 500 nm.

In step 58, it is determined whether the parameter in the cleaning unit 4 meets a cleaning parameter target. If the cleaning parameter target has been reached, the procedure proceeds to the next step, and if the cleaning parameter target is been reached, step 57 is performed again.

In step 59, after the cleaning step is completed, the washing liquid is discharged through the discharge line 42 of the cleaning unit 4, and then dewatering or injection of rinsing water is performed. The rinsing water is tap water, which is injected from a direct input end of a cleaning tank 8, or is injected into the cleaning unit 4 after passing through the nano microbubble generation unit 3 to contain nano microbubbles. However, because the latter contains nano microbubbles, it can have a higher cleaning capability, a shorter rinsing time, and a smaller number of times of rinsing than the tap water directly injected.

Refer to Table 2 for examples of detection results after cleaning by using several different types of washing liquid.

| Item | Unit | General chemical detergent | Nano ionic water of subject disclosure | Nano microbubble water of subject disclosure |
|---|---|---|---|---|
| pH value | — | 12 | 12.7 | 7.7 |
| Conductivity | μmho/cm | 2010 | 3660 | 230 |
| Nitrate nitrogen | mg/L | 7.6 | 5.1 | 3.5 |
| Ammonia nitrogen | mg/L | ND | ND | ND |
| Suspended solids (SS) | mg/L | 40 | 45 | 40 |
| Chemical oxygen demand (COD) | mg/L | 3850 | 621 | 184 |
| P | mg/L | 2.4 | ND | ND |
| K | mg/L | 384 | 949 | 13 |
| Na | mg/L | 114 | 36 | 33 |

Figure 4:
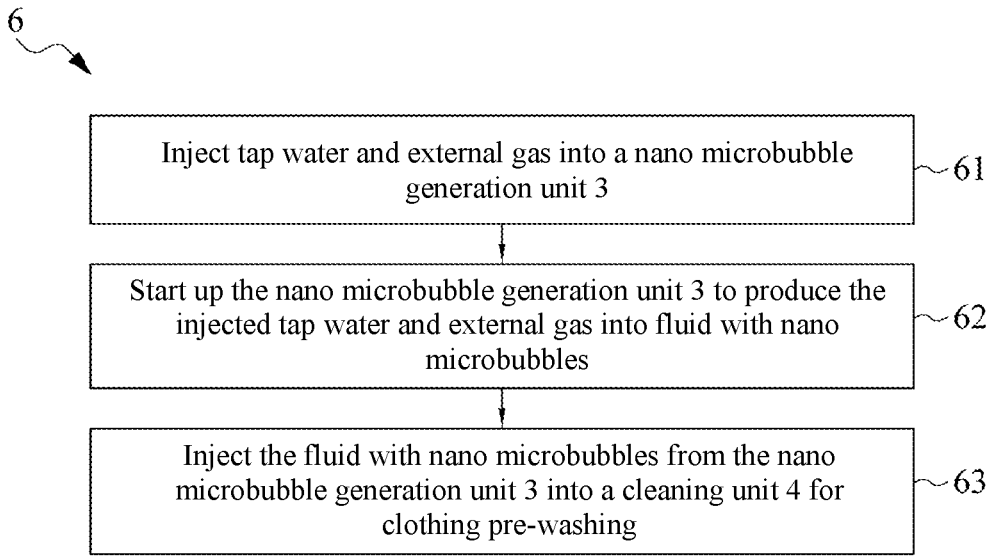
FIG. 4 is a flowchart of a clothing pre-washing method according to an embodiment of the subject disclosure.

Before performing a method 5 of washing clothes shown in FIG. 3, a clothing pre-washing procedure may be first performed on to-be-washed clothes placed in the cleaning unit 4. FIG. 4 is a flowchart of a clothing pre-washing method 6 according to an embodiment of the subject disclosure. In some embodiments of the subject disclosure, the clothing pre-washing method 6 includes steps 61, 62, and 63.

In step 61, external tap water and external air or ozone may be injected into the nano microbubble generation unit 3.

In step 62, the nano microbubble generation unit 3 is started up to produce the injected tap water and external gas into fluid with nano microbubbles.

In step 63, the fluid having nano microbubbles made by the nano microbubble generation unit 3 is injected into the cleaning unit 4 to perform a pre-washing procedure on the clothes placed in the cleaning unit 4.

Figure 5:
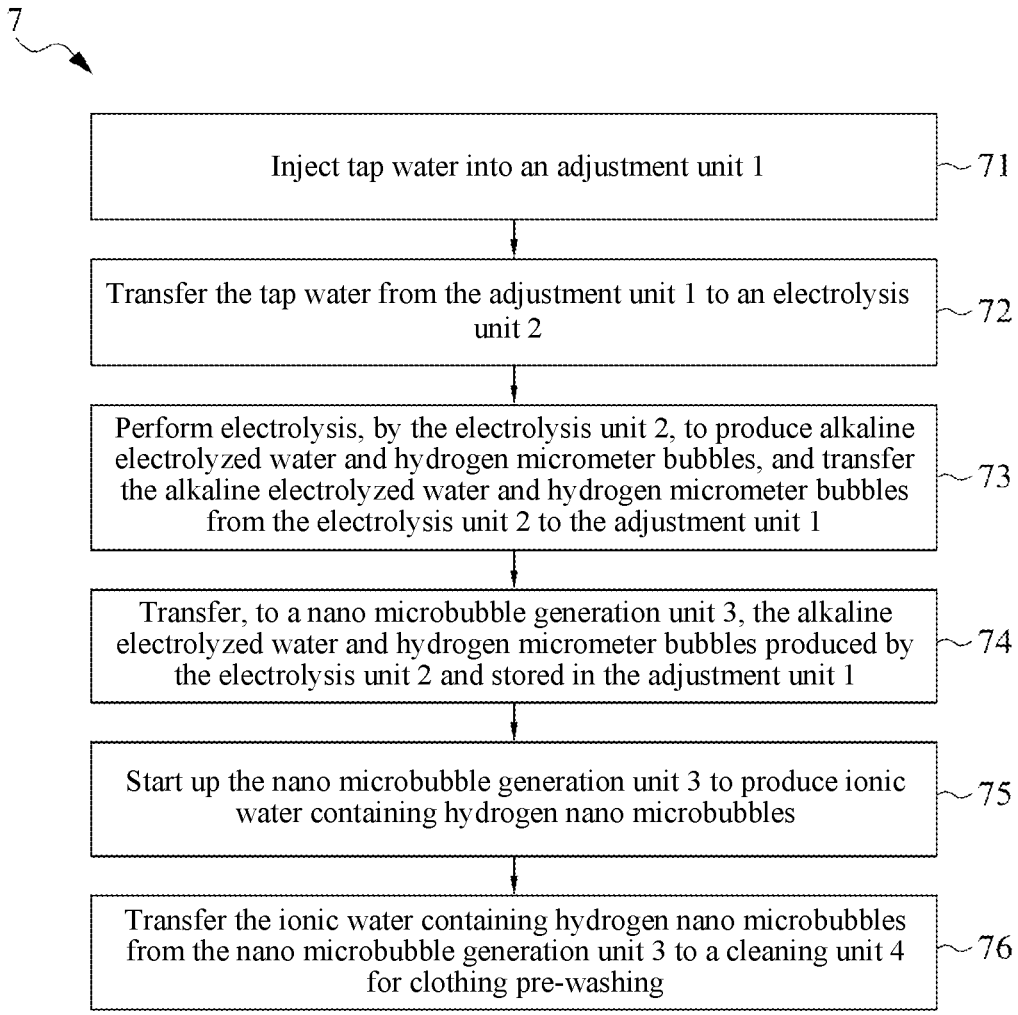
FIG. 5 is a flowchart of a clothing pre-washing method according to an embodiment of the subject disclosure.

FIG. 5 is a flowchart of another clothing pre-washing method 7 according to an embodiment of the subject disclosure. In some embodiments of the subject disclosure, a clothing pre-washing method 7 includes steps 71, 72, 73, 75, and 76.

In step 71, external tap water may be injected into the adjustment unit 1.

In step 72, the first fluid circulation unit 101 is started up to draw the tap water in the adjustment unit 1 to the cathode electrolysis cell 21 of the electrolysis unit 2.

In step 73, the electrolysis unit 2 performs electrolysis, so that the injected tap water is electrolyzed to produce hydrogen micron bubbles and alkaline electrolyzed water with hydroxide ions; subsequently, the first fluid circulation unit 101 transfers the alkaline electrolyzed water with hydroxide ions and hydrogen micron bubbles generated by electrolysis from the electrolysis unit 2 to the adjustment unit 1.

In step 74, the second fluid circulation apparatus 52 is started up to draw, from the adjustment unit 1, the alkaline electrolyzed water and hydrogen micron bubbles continuously produced by the electrolysis unit 2 and transferred back to the adjustment unit 1, and inject them into the nano microbubble generation unit 3.

In step 75, the high-pressure and mechanical cutting assembly in the nano microbubble generation unit 3 cuts the hydrogen microbubbles injected into the nano microbubble generation unit 3 into smaller hydrogen nano microbubbles.

In step 76, the fluid having nano microbubbles made by the nano microbubble generation unit 3 is injected into the cleaning unit 4 to perform a pre-washing procedure on the clothes placed in the cleaning unit 4.

The foregoing pre-washing methods 6 and 7 may be used in predetermined steps of improving the cleaning effect and reducing the cleaning time and the use amount of washing liquid.

Figure 6A:
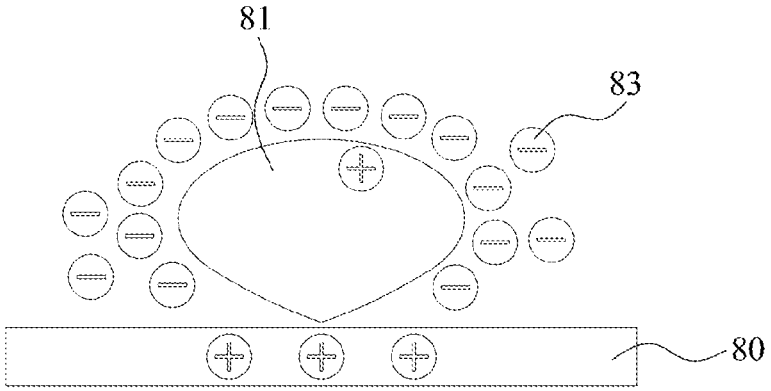
FIG. 6A, FIG. 6B, and FIG. 6C show schematic diagrams of a dirt cleaning capability of nano ionic water.
Figure 6B:
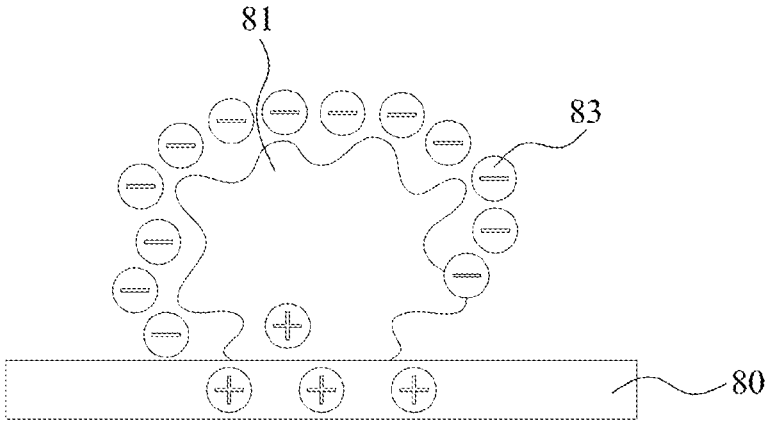
Figure 6C:
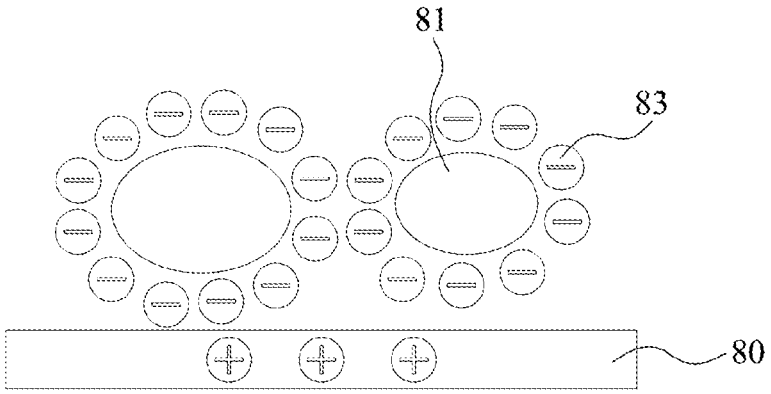

Regarding the cleaning capability of nano ionic water, referring to FIG. 6A, FIG. 6B, and FIG. 6C, dirt 81 in FIG. 6A adhered to a surface of an object (that is, clothing 80), by the fine property of the nano ionic water, hydroxide ions 83 quickly diffuse to a surface of the dirt 81 and penetrate into an interface between the dirt 81 and the clothing 80 with a high penetration and diffusion rate (briefly referred to as "penetration"). Furthermore, the hydroxide ions 83 in FIG. 6B surround the dirt 81, so that negative charges between the dirt 81 and the clothing 80 and between the dirt 81 and the dirt 81 are repulsive and fall off, the dirt 81 is desorbed from an interface of the clothing 80, and the desorbed hydroxide ions 83 surround the dirt 81 and independently suspend in the water, and cannot affect the surface of the cleaned clothes (briefly referred to as "peeling"). The dirt 81 in FIG. 6C disintegrates because the hydroxide ions 83 can decompose oil or protein of the dirt 81 (briefly referred to as "alkalization"). Therefore, the descaling function of the nano ion is jointly implemented by mechanisms such as penetration, peeling, and alkalization.

The pH value of the hydroxide ion or alkaline electrolyzed water is proportional to an electrolysis time, and is inversely proportional to the ORP and the conductivity concentration. It can be seen from the ORP that the hydroxide ion has reducing power, and the reducing power of the hydroxide ion is increased as the ORP decreases. When the nuclear magnetic resonance (NMR) $O^{17}$ spectra of general tap water is compared with alkaline electrolyzed water, it can be found that if the half-height width of alkaline electrolyzed water is smaller than that of general tap water, it means that the water molecule cluster of the alkaline electrolyzed water is smaller than that of the general tap water.

Figure 7A:
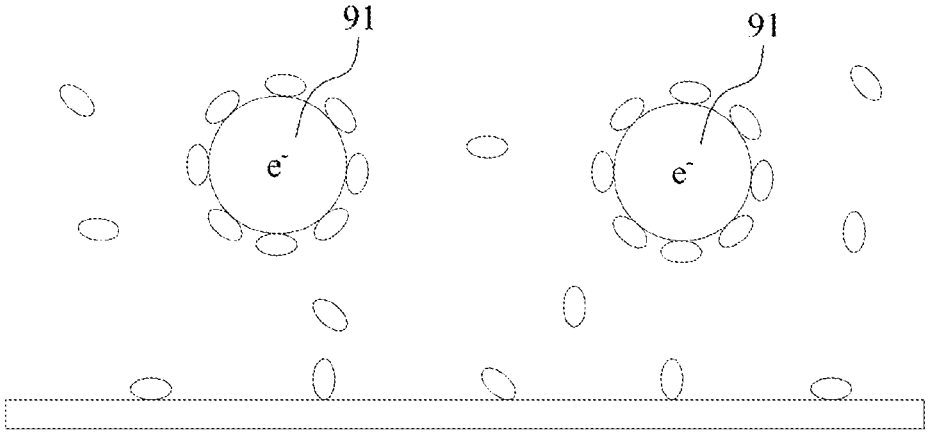
FIG. 7A, FIG. 7B, FIG. 7C, and FIG. 7D show schematic diagrams of a dirt cleaning capability of nano microbubble water.
Figure 7B:
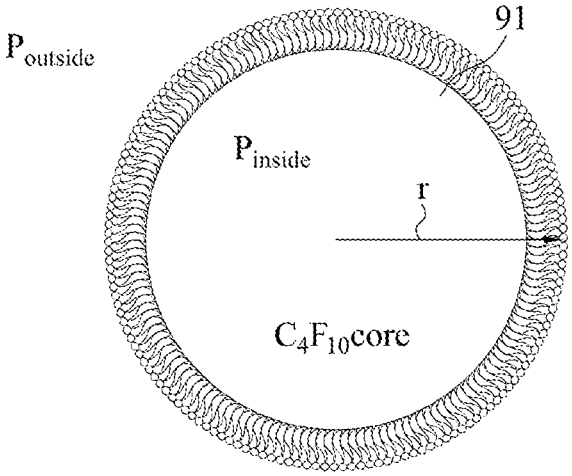
Figure 7C:
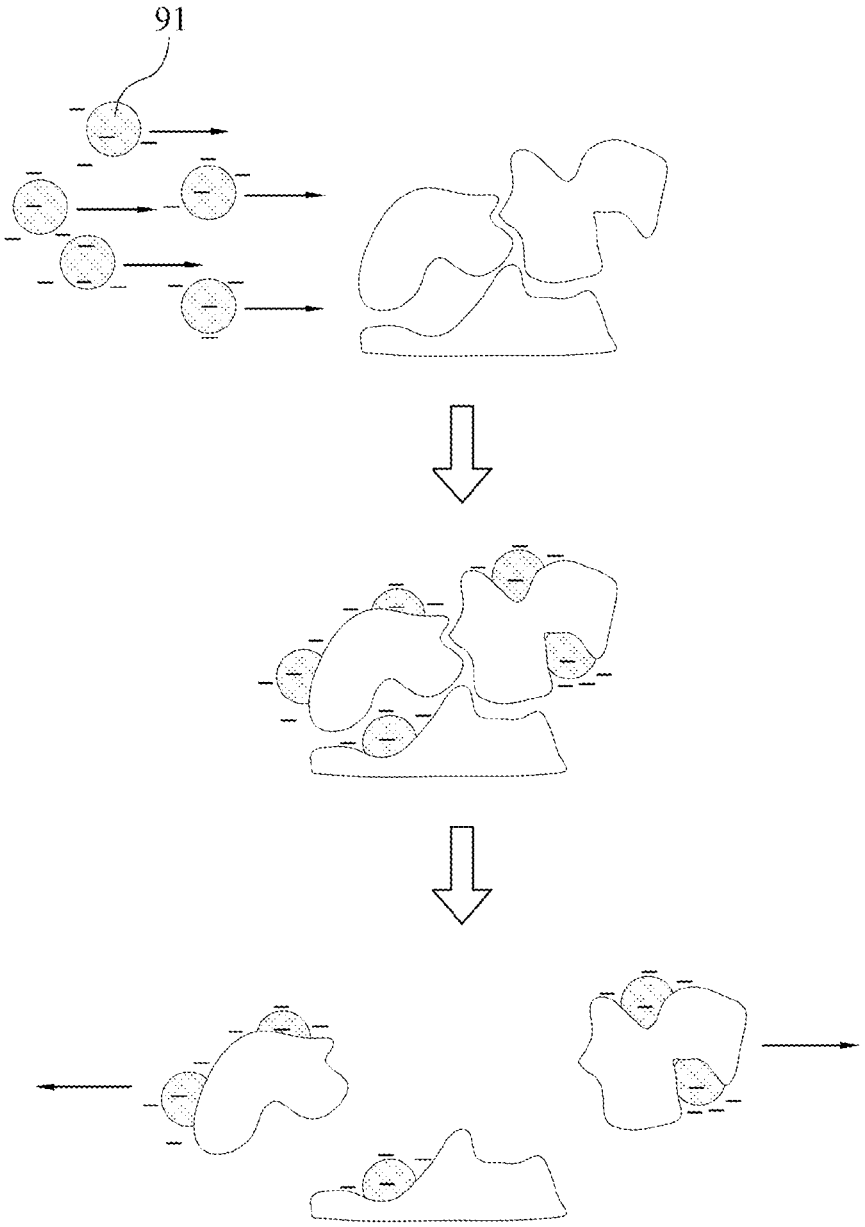
Figure 7D:
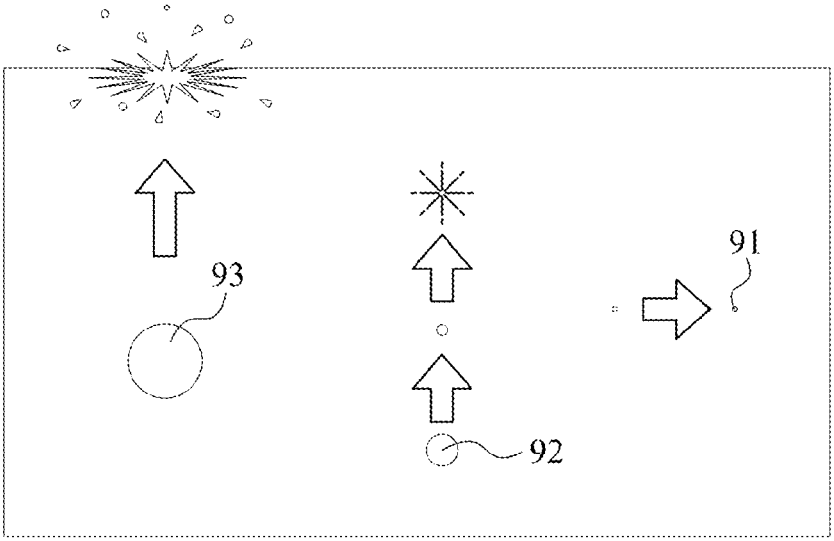

Regarding the cleaning capability of nano microbubbles, referring to FIG. 7A, FIG. 7B, FIG. 7C, and FIG. 7D, a gas-liquid interface formed by nano microbubbles 91 in water in FIG. 7A has a characteristic of easily accepting $H^+$ and $OH^-$, and generally, it is easier for cations to leave the gas-liquid interface than anions, so that the interface is often negatively charged. FIG. 7B reveals that the nano microbubble 91 tends to adsorb counter ions in the medium, especially high-valent counter ions, thereby forming a stable electric double layer structure. The negatively charged nano microbubble 91 in FIG. 7C easily penetrates into dirt 90, and the dirt 90 is decomposed and separated due to the electric double layer structure. The nano microbubble 91 in FIG. 7D is, for example, hydrogen. According to the Stokes' theorem, the rising speed of the bubble in water is proportional to the square of the diameter of the bubble. The smaller the diameter of the bubble, the lower the rising speed of the bubble. The rising speed of a large bubble with a diameter of 1 mm in water is 6 mm/min, while the rising speed of a small bubble with a diameter of 10 μm in water is 3 μm/min. The rising speed of the small bubble is 1/2000 of that of the large bubble, and the rising speed of the nano microbubble is lower. The properties of the extremely low rising speed and high solubility helps the nano microbubble to stay in the washing liquid during the washing process, and the changes and differences in the number of bubbles and the bubble diameter are not easy to show. The nano microbubble 91 shown in FIG. 7D has a low rising speed and can exist for a long time in water. A micron bubble 92 rises faster than the nano microbubble 91 and can exist in water for a shorter time. A bubble 93 having a general size rises the fastest and can exist in water for the shortest time.

Figure 8:
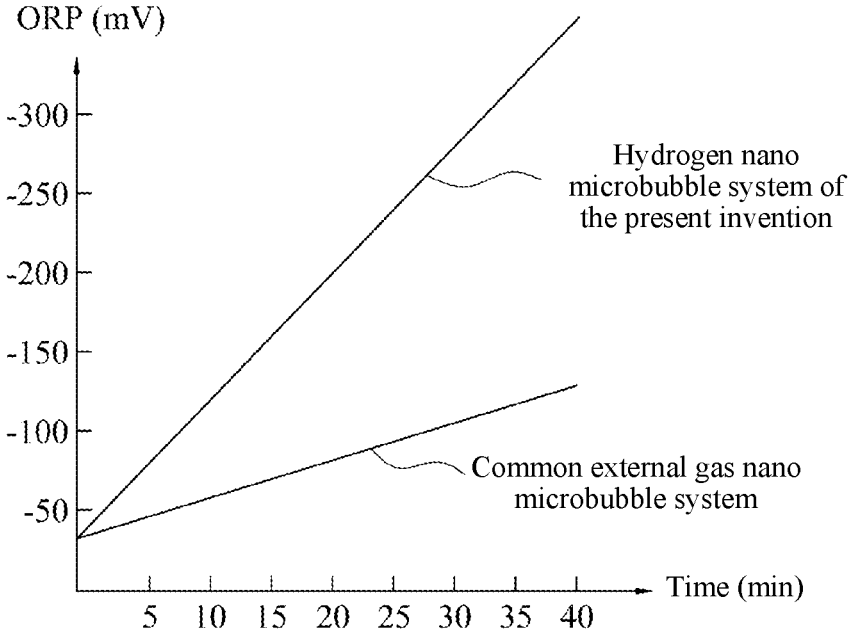
FIG. 8 shows oxidation-reduction potential (ORP) comparison between a hydrogen nano microbubble system of the subject disclosure and a conventional external gas nano microbubble system.

Referring to FIG. 8, in an embodiment of the subject disclosure, the case of using the nano ionic water to generate hydrogen microbubbles after electrolysis in the electrolysis unit 2 and then generate hydrogen nano microbubbles through the nano microbubble generation unit 3 is more efficient and has a higher generation speed than using an external hydrogen source. Because the external hydrogen source is used as the main gas for generating bubbles in the nano microbubble system instead of separately using the hydrogen microbubbles generated after electrolysis in the subject disclosure, the amount of hydrogen escaping into the air is large, which is relatively unsafe.

In the nano microbubble system of the subject disclosure, when the circulation system is stopped and an ultrasonic apparatus is started up, although the microbubbles disappear quickly, the content of hydrogen of the nano ionic water in the liquid phase still remains above 0.8 ppm. During the cleaning process, the nano microbubbles of the subject disclosure continue to remain at a sufficient level, and the detected ORP also shows a high negative value, which means that the content of nano microbubbles in water is always maintained at a high level.

The features of several embodiments have been summarized above, so that a person skilled in the art can better understand the aspects of the subject disclosure. A person skilled in the art should understand that he or she can easily use the subject disclosure as a basis for designing or modifying other processes and structures to implement the same purpose and/or achieve the same advantages of the embodiments introduced in this specification. A person skilled in the art should also be aware of that these equivalent structures should not depart from the spirit and scope of the subject disclosure, and can make various changes, substitutions and modifications in this specification.

REFERENCE NUMERALS

1: Adjustment unit
2: Electrolysis unit
3: Nano microbubble generation unit
4: Cleaning unit
5: method of washing clothes
6: Pre-cleaning method
7: Pre-cleaning method
10: Fluid inlet
13: Pipeline
16: Detection unit
17: Warming unit
18: Hydrogen processing unit
21: Cathode electrolysis cell
22: Anode electrolysis cell
23: Ion exchange membrane
30: Fluid inlet
31: Fluid inlet end
32: External gas inlet end
33: Gas-liquid mixing section
34: Gas-liquid rotary pressurization section
35: Nano microbubble mechanical cutting section
36: Fluid outlet end

39: Pipeline
42: Discharge pipeline
51: Step
52: Step
53: Step
54: Step
55: Step
56: Step
57: Step
58: Step
59: Step
61: Step
62: Step
63: Step
71: Step
72: Step
73: Step
74: Step
75: Step
76: Step
80: Clothing
81: Dirt
83: Hydroxide ion
91: Nano microbubble
92: Micron bubble
93: Bubble
100: Clothing washing system
101: First fluid circulation unit
102: Second fluid circulation unit
130: Fluid inlet
351: Cutter

What is claimed is:

1. A clothing washing system, comprising:

a first fluid tank with a fluid inlet, configured to receive fluid from a first external fluid source and store fluid;

an electrolysis apparatus, being in fluid communication with the first fluid tank, and configured to electrolyze fluid loaded therein;

a first pump, connected to the first fluid tank and the electrolysis apparatus, and configured to transfer fluid in the first fluid tank to the electrolysis apparatus and transfer the fluid in the electrolysis apparatus to the first fluid tank, wherein the first pump, the first fluid tank, and the electrolysis apparatus jointly constitute a first fluid circulation path, enabling bidirectional fluid circulation between the first fluid tank and the electrolysis apparatus;

a nano microbubble generation apparatus, being in fluid communication with the first fluid tank, and configured to pressurize and cut a gas in fluid, such that the gas in the fluid becomes nano-scale microbubbles with a diameter less than 500 nm;

a second pump, connected to the first fluid tank and the nano microbubble generation apparatus, and configured to transfer the fluid in the first fluid tank to the nano microbubble generation apparatus and transfer fluid in the nano microbubble generation apparatus to the first fluid tank, wherein the second pump, the first fluid tank and the nano microbubble generation apparatus jointly constitute a second fluid circulation path, enabling bidirectional fluid circulation between the first fluid tank and the nano microbubble generation apparatus; and a second fluid tank, being in fluid communication with the first fluid tank and configured to receive fluid from the first fluid tank and accommodate to-be-washed clothes.

2. The clothing washing system according to claim 1, further comprising a detector connected to the first fluid tank, the electrolysis apparatus and the nano microbubble generation apparatus, wherein the detector is configured to detect a pH value, an ORP value, an electrical conductivity and a temperature of fluid in the first fluid tank and detect a current and a voltage of the electrolysis apparatus, a flow rate of fluid in the electrolysis apparatus, an electrolyte concentration in an anode electrolysis cell of the electrolysis apparatus.

3. The clothing washing system according to claim 2, further comprising a hydrogen processing apparatus installed in the first fluid tank, wherein the hydrogen processing apparatus is configured to discharge or dilute hydrogen in the first fluid tank.

4. The clothing washing system according to claim 3, wherein the detector is further configured to control the hydrogen processing apparatus based on a concentration of the hydrogen in the first fluid tank.

5. The clothing washing system according to claim 2, further comprising a warming apparatus, wherein the warming apparatus is installed in the first fluid tank and configured to heat fluid within the first fluid tank.

6. The clothing washing system according to claim 5, wherein the detector is further configured to control the warming apparatus based on a temperature of the fluid in the first fluid tank.

7. The clothing washing system according to claim 2, wherein the detector is further configured to control the first pump and the second pump, based on a parameter of fluid, which has been electrolyzed by the electrolysis apparatus, to cause a circulation of fluid.

8. The clothing washing system according to claim 1, wherein the nano microbubble generation apparatus is connected to a second external fluid source, and is in fluid communication with the second fluid tank.

9. The clothing washing system according to claim 1, wherein the electrolysis apparatus comprises a cathode electrolysis cell, an anode electrolysis cell, and an ion exchange membrane between the cathode electrolysis cell and the anode electrolysis cell, the cathode electrolysis cell being connected to the first pump.

10. The clothing washing system according to claim 1, wherein the nano microbubble generation apparatus comprises:

a fluid inlet end connected to the first pump and configured to receive fluid and gas from the first fluid tank;

a gas-liquid mixing section, configured to mix, in a vortex manner, the fluid and the gas from the fluid inlet end into gas-liquid mixed fluid;

a gas-liquid rotary pressurization section, configured to rotate and pressurize the gas-liquid mixed fluid; and a nano microbubble mechanical cutting section, configured to perform cutting on the pressurized gas-liquid mixed fluid to generate the nano-scale microbubbles in the fluid.

11. The clothing washing system according to claim 10, wherein the nano microbubble mechanical cutting section comprises a cutter, configured to perform shear cutting on the pressurized gas-liquid mixed fluid.

12. The clothing washing system according to claim 10, wherein the nano microbubble generation apparatus further comprises an external gas inlet end configured to introduce external gas into the nano microbubble generation apparatus when the fluid inlet end is connected to a third external fluid source and introduces external fluid from the third external fluid source into the nano microbubble generation apparatus.

* * * * *